US008071915B2

(12) United States Patent
Mukai

(10) Patent No.: US 8,071,915 B2
(45) Date of Patent: Dec. 6, 2011

(54) HAIR IRON

(76) Inventor: Takashi Mukai, Sumida (JP)

( * ) Notice: Subject to any disclaimer, the term of this patent is extended or adjusted under 35 U.S.C. 154(b) by 894 days.

(21) Appl. No.: 11/922,862

(22) PCT Filed: Jun. 26, 2007

(86) PCT No.: PCT/JP2007/062810

§ 371 (c)(1),
(2), (4) Date: Dec. 26, 2007

(87) PCT Pub. No.: WO2009/001439

PCT Pub. Date: Dec. 31, 2008

(65) Prior Publication Data

US 2010/0078037 A1 Apr. 1, 2010

(51) Int. Cl.
*A45D 1/00* (2006.01)
*A45D 1/04* (2006.01)
*A45D 1/08* (2006.01)

(52) U.S. Cl. ..... 219/225; 132/224; 132/269

(58) Field of Classification Search ..... None
See application file for complete search history.

(56) References Cited

U.S. PATENT DOCUMENTS 5,913,478 A * 6/1999 Ochsman ..... 24/7
5,933,922 A * 8/1999 Ochsman ..... 24/3.11
6,053,178 A 4/2000 Todd
6,156,990 A * 12/2000 Ellis ..... 219/56.21
6,278,086 B1 8/2001 Janouch et al.
6,837,887 B2 * 1/2005 Woloszko et al. ..... 606/41
6,974,453 B2 * 12/2005 Woloszko et al. ..... 606/41
7,749,222 B2 * 7/2010 Lu et al. ..... 606/51
2006/0150996 A1 7/2006 Lun et al.
2006/0207625 A1 9/2006 Chan
2007/0270798 A1 * 11/2007 Lu et al. ..... 606/51

FOREIGN PATENT DOCUMENTS

JP 2001-137038 5/2001

* cited by examiner

*Primary Examiner* — Joseph M Pelham
(74) *Attorney, Agent, or Firm* — Jordan and Hamburg LLP

(57) ABSTRACT

A hair iron is capable of preventing hair under treatment from drying.

The hair iron has clamp arms. Heads of the clamp arms are provided with relaxing bodies that face each other. The relaxing bodies have respective thermal plates. The thermal plates heat and correct hair held between the relaxing bodies. A relaxing surface of at least one of the relaxing bodies has a platinum layer formed on a base material. Between the base material and the platinum layer, a titanium dioxide layer is formed. Between the base material and the titanium dioxide layer, a nickel layer is formed. Between the titanium dioxide layer and the platinum layer, a nickel layer is formed. A magnet plate is arranged behind the thermal plate and is extended along the relaxing surface.

5 Claims, 6 Drawing Sheets

HAIR IRON

BACKGROUND OF THE INVENTION

The present invention relates to a hair iron used to, for example, relax curly hair.

There is a conventional hair iron as shown in FIGS. 11(*a*) and 11(*b*) (reference to Patent Literature 1). FIG. 11A is a general view showing the hair iron and FIG. 11B is a sectional view showing the inside thereof.

In FIGS. 11(*a*) and 11(*b*), the conventional hair iron 201 includes an iron body 203 and an electric cord 205 connected thereto. An intermediate part of the cord 205 is connected to a temperature controller 207 and an end of the cord 205 is fixed to a plug 209.

The iron body 203 includes a pair of clamp arms 211 and 213 made of resin. The clamp arms 211 and 213 have bases 215 and 217 that are pivotally joined together. Heads 219 and 221 of the clamp arms 211 and 213 have relaxing bodies 223 and 225 that face each other. The relaxing bodies 223 and 225 are movably supported by the clamp arms 211 and 213, so that the relaxing bodies 223 and 225 may move forward and backward relative to each other within a predetermined range. On the back of each of the relaxing bodies 223 and 225, there is a spring 227 to push the relaxing body forward.

To operate the hair iron 201, the plug 209 is inserted into a socket and the relaxing bodies 223 and 225 are heated with the temperature controller 207. Hair is held between the relaxing bodies 223 and 225 and the relaxing bodies 223 and 225 are slid along the hair to heat and relax the hair.

When relaxing curly hair, the relaxing bodies 223 and 225 are controlled to provide high temperatures of, for example, 60 to 180° C. The high temperatures quickly dry the hair during the treatment, to damage the hair and remove a gloss from the finished hair.

Patent Literature 1: Japanese Patent Application Laid-Open Publication No. 2001-137038

SUMMARY OF THE INVENTION

A problem to be solved by the present invention is to quickly dry hair during the treatment, to damage the hair and remove a gloss from finished hair.

In order to prevent hair in treatment from quickly drying, the present invention is mainly characterized in that a hair iron includes clamp arms each having a base, a midsection serving as a grip, and a head, the bases of the clamp arms being pivotally joined together so that the heads may conduct a clamping operation when the grips are grasped; relaxing bodies attached to the heads of the clamp arms, respectively, the relaxing bodies facing each other, each of the relaxing bodies having a thermal plate and a relaxing surface formed on the thermal plate, the relaxing bodies in the clamping operation holding hair between the relaxing surfaces and relaxing the hair with heat supplied from the thermal plates; and a platinum layer formed on a base material of the relaxing surface of at least one of the relaxing bodies.

The hair iron according to the present invention includes clamp arms each having a base, a midsection serving as a grip, and a head, the bases of the clamp arms being pivotally joined together so that the heads may conduct a clamping operation when the grips are grasped; relaxing bodies attached to the heads of the clamp arms, respectively, the relaxing bodies facing each other, each of the relaxing bodies having a thermal plate and a relaxing surface formed on the thermal plate, the relaxing bodies in the clamping operation holding hair between the relaxing surfaces and relaxing the hair with heat supplied from the thermal plates; and a platinum layer formed on a base material of the relaxing surface of at least one of the relaxing bodies.

Accordingly, the platinum layer provides a water-retaining function for hair in treatment to prevent the hair treated with heat from drying to maintain a healthy condition of the hair after treatment.

DETAILED DESCRIPTION OF THE INVENTION

A hair iron is characterized in that it employs a platinum layer to prevent hair in treatment from drying.

Embodiment 1

Figure 1:
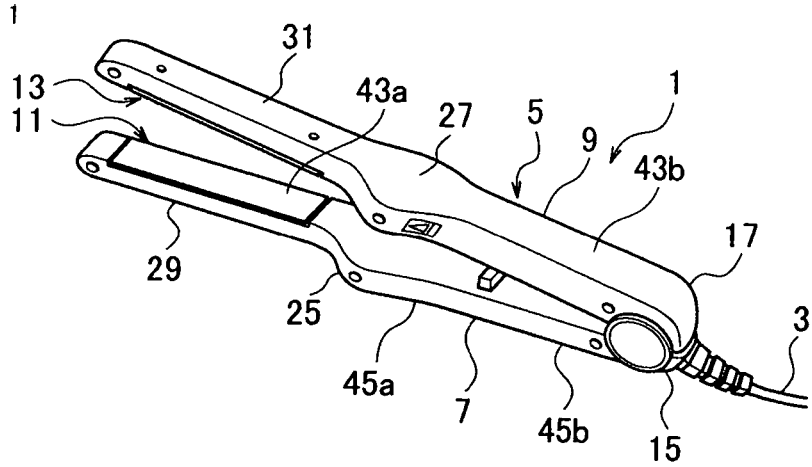
FIG. 1 is a perspective view showing a hair iron (according to an embodiment of the present invention).
Figure 2:
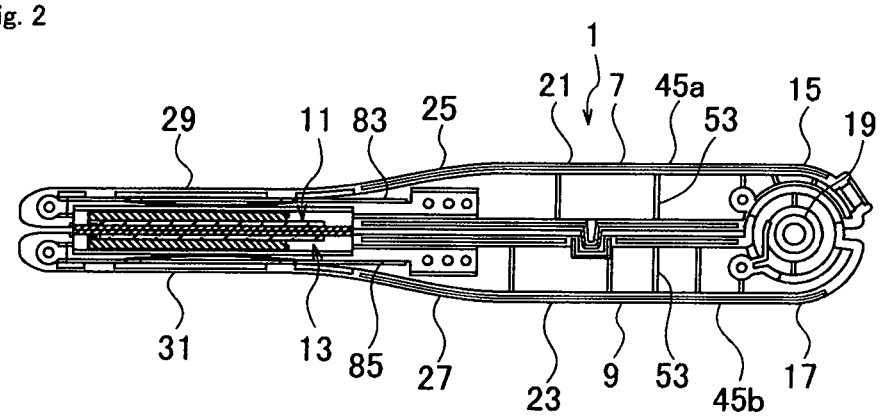
FIG. 2 is a plan view showing the inside of the hair iron (according to the embodiment of the present invention).
Figure 3:
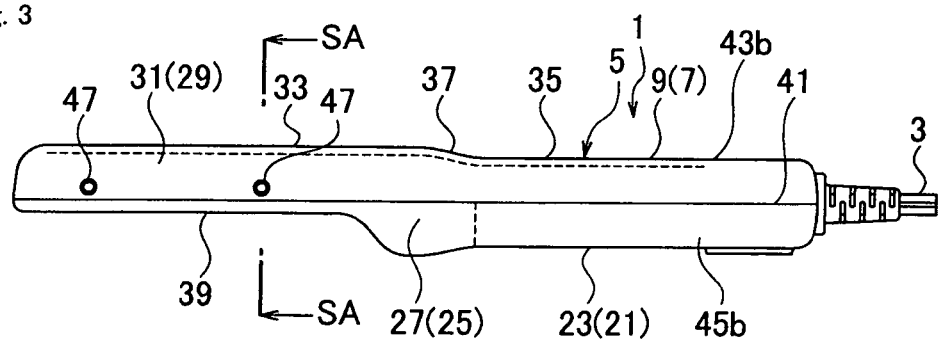
FIG. 3 is a side view showing the hair iron (according to the embodiment of the present invention).
Figure 4:
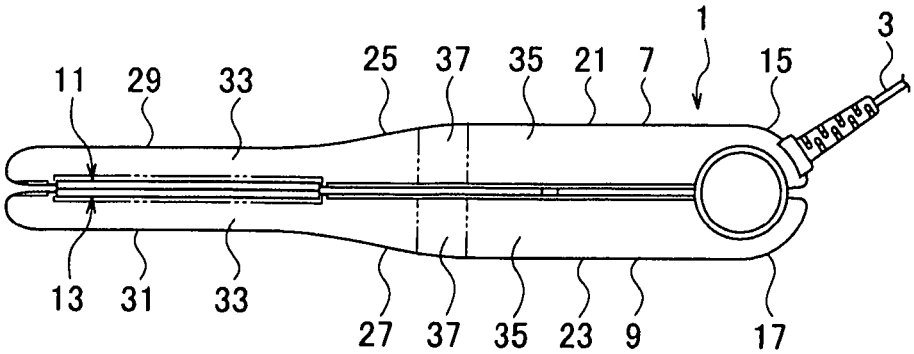
FIG. 4 is a plan view showing the hair iron (according to the embodiment of the present invention).
Figure 5:
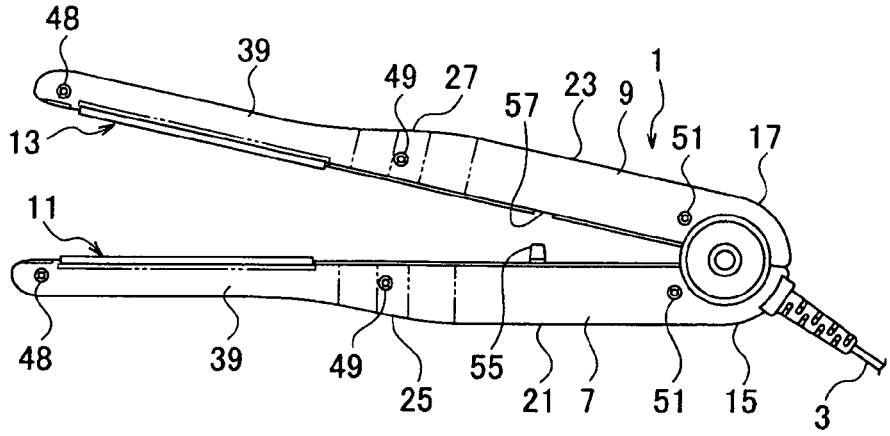
FIG. 5 is a bottom view showing the hair iron in an open state (according to the embodiment of the present invention).

FIGS. 1 to 5 show a hair iron according to an embodiment of the present invention, in which FIG. 1 is a perspective view showing the hair iron, FIG. 2 is a plan view showing the inside of the same, FIG. 3 is a side view showing the same, FIG. 4 is a plan view showing the same, and FIG. 5 is a bottom view showing the same.

In FIGS. 1 to 5, the hair iron 1 has a body 5 to which an electric cord 3 is connected. The cord 3 has an electric plug and the like.

The body 5 has a pair of clamp arms 7 and 9 and a pair of relaxing bodies 11 and 13. The clamp arms 7 and 9 are made of resin such as polyester-based engineering plastic having a liner coefficient of expansion of, for example, $8.8\times10^{-5}$ cm/° C. The clamp arms 7 and 9 are pivotally joined together at their bases 15 and 17 with a rotary shaft 19. The clamp arms 7 and 9 have midsections serving as grips 21 and 23. As shown in FIGS. 2, 4, and 5, the grips 21 and 23 are relatively widened to easily be grasped. The widths of the grips 21 and 23 are substantially equal to the widths of the bases 15 and 17.

At front ends of the grips 21 and 23, there are slopes serving as pressing points 25 and 27. To clamp the clamp arms 7 and 9 by grasping the grips 21 and 23, one may put the thumb and forefinger on the pressing points 25 and 27 and apply power. In the side view of FIG. 3, the pressing point 27 (25) is slightly expanded from the grip 23 (21), so that one may easily put the thumb and forefinger thereon.

The grips 21 and 23 may have, for example, a temperature controller (not shown), a temperature display (not shown), and the like. The temperature controller includes temperature setting buttons provided on each surface of the grips 21 and 23 and the like and is connected between the cord 3 and ceramic heaters 69 to be explained later, to phase-control AC power and adjust the temperatures of the ceramic heaters 69. The phase-controlled temperature is detected by a thermistor and is used to correct the temperature. The temperature detected by the thermistor is displayed on the temperature display by LEDs.

As shown in FIGS. 2, 4 and 5, heads 29 and 31 of the clamp arms 7 and 9 are narrower in an abutting direction of the heads 29 and 31 than the grips 21 and 23. As shown in FIG. 3, the heads 29 and 31 are biased to one side with respect to the grips 21 and 23. Namely, a side face 33 of the head 31 (29) protrudes from a side face 35 of the grip 23 (21) to one side and the side faces 33 and 35 are connected to each other through a slope 37 to form a continuous step. An other side face 39 of the head 31 (29) is recessed toward the center line of the grip 23 (21) in proportion to the protruding side face 33.

The clamp arms 7 and 9 each are hollow. The clamp arm 9 (7) is divided along a dividing line 41 into arm parts 43*b* (43*a*) and 45*b* (45*a*) to form a coupled structure in FIG. 3. These arm parts 43*b* and 45*b* (43*a* and 45*a*) are coupled together with screws 48, 49, and 51 at the head 31 (29), grip 23 (21), and base 17 (15), for example. The head 31 (29) of the arm part 43*b* (43*a*) has holes 47 for fastening.

The hollow grips 21 and 23 have reinforcing ribs 53. The clamp arm 7 has a projection 55 to face the other clamp arm 9 and the clamp arm 9 has a recess 57 to receive the projection 55. The projection 55 abuts against the bottom of the recess 57, to serve as a stopper.

The bases 15 and 17 of the clamp arms 7 and 9 are pivotally joined together, and when the grips 21 and 23 are grasped, the heads 29 and 31 carry out a clamping operation.

Figure 6:
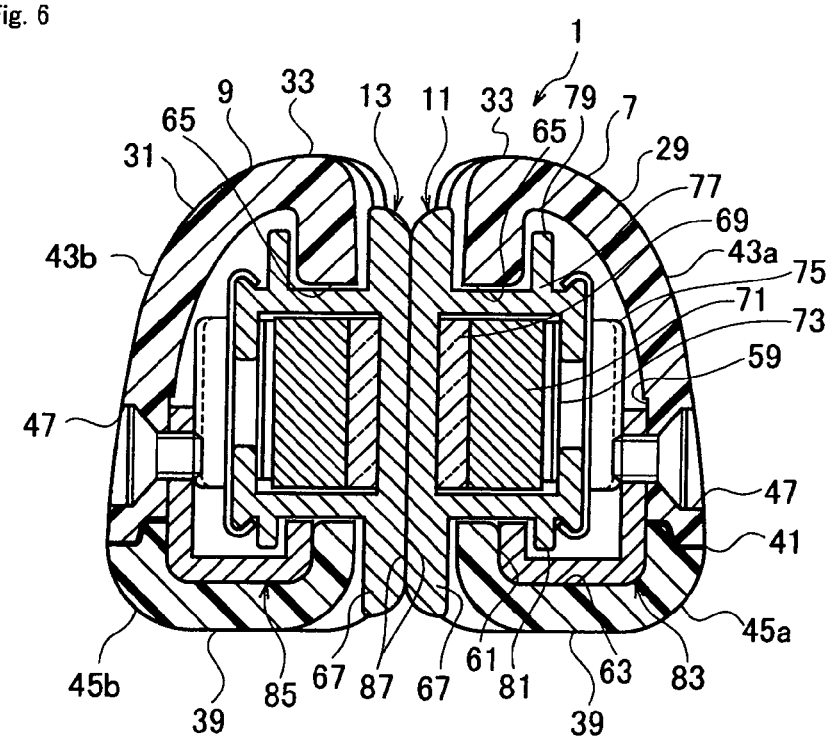
FIG. 6 is an enlarged section taken along a line SA-SA of FIG. 3 (according to the embodiment of the present invention).
Figure 7:
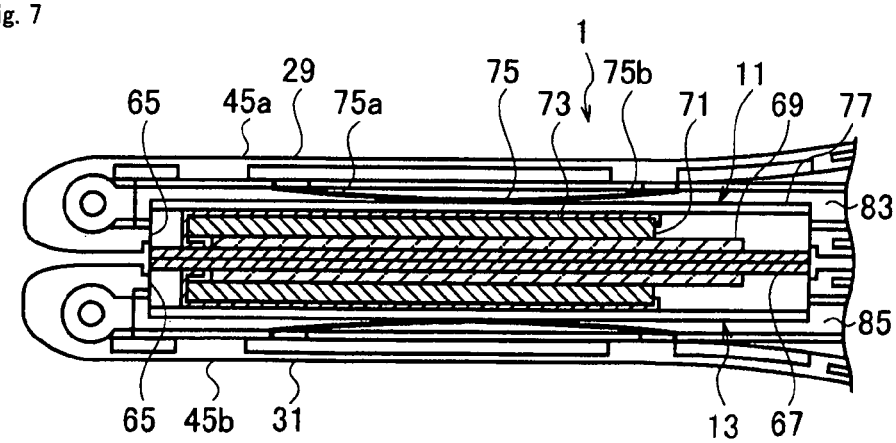
FIG. 7 is an enlarged plan view showing the inside of each head of the hair iron (according to the embodiment of the present invention).
Figure 8A:
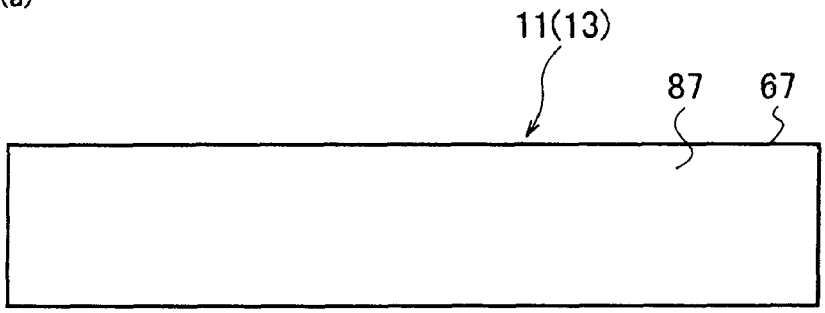
FIG. 8(*a*) is a front view showing a relaxing body, FIG. 8(*b*) is a back view showing the same, FIG. 8(*c*) is a plan view showing the same, FIG. 8(*d*) is a sectional view showing the same and FIG. 8(*e*) is a sectional view partly showing a relaxing surface (according to the embodiment of the present invention).
Figure 8B:
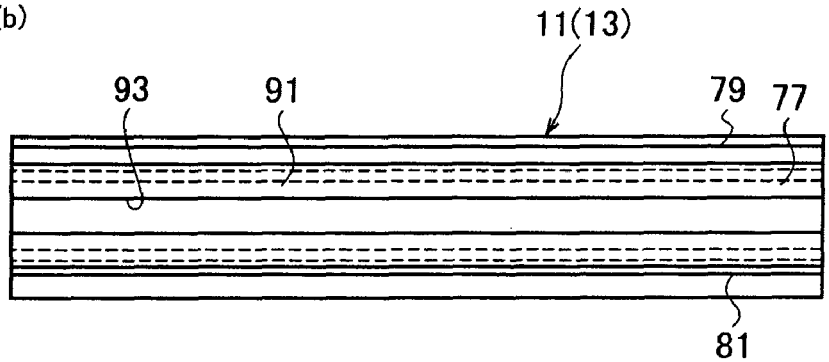
Figure 8C:
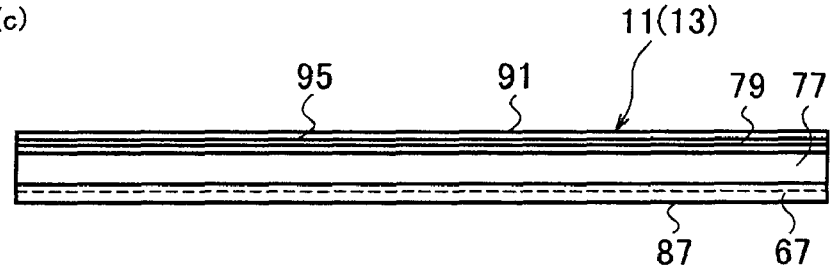
Figure 8D:
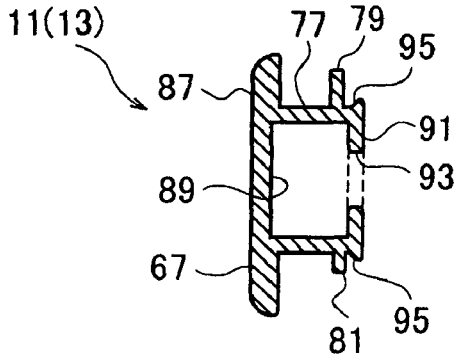
Figure 8E:
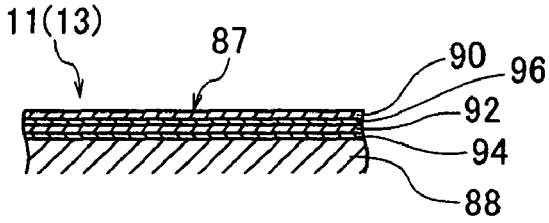

FIG. 6 is an enlarged sectional view taken along a line SA-SA of FIG. 3 and showing the heads 29 and 31 of the clamp arms 7 and 9. FIG. 7 is an enlarged plan view showing sections of the relaxing bodies 11 and 13 attached to the heads 29 and 31.

In FIG. 7, the arm parts 43*a* and 43*b* are removed. The heads 29 and 31 of the clamp arms 7 and 9 are symmetrical and have the same configuration, and therefore, the head 29 will mainly be explained. The explanation related to the head 29 is applicable to the head 31.

In FIGS. 6 and 7, the head 29 has flat vertical walls 59 and 61 and a flat bottom wall 63 that internally contain a core 83. The head 31 has similar vertical and bottom walls to internally contain a core 85. The head 29 has a relaxing body support hole 65 to movably support the relaxing body 11, so that the relaxing body 11 may move toward and away from the other relaxing body 13.

The relaxing bodies 11 and 13 are arranged at the heads 29 and 31 of the clamp arms 7 and 9, to face each other. When hair is held between the clamp arms 7 and 9, the relaxing bodies 11 and 13 heat and relax the hair.

The relaxing body 11 has a thermal plate 67, the ceramic heater 69, a magnet plate 71, and a first spring 73 and is pushed by a second spring 75.

The thermal plate 67 is made of a heat-conductive light material such as aluminum and has a rectangular shape when seen from the opposite relaxing body 13. The back of the thermal plate 67 is provided with a casing 77 integrally. The relaxing body 11 is movably supported in the relaxing body support hole 65 so that the relaxing body 11 may move toward and away from the other relaxing body 13. The relaxing body 13 is also movably supported so that it may move toward and away from the relaxing body 11.

Top and bottom walls of the casing 77 have stoppers 79 and 81 to limit the movement of the thermal plate 67. The ceramic heater 69, magnet plate 71, and first spring 73 are contained in the casing 77. Therefore, each relaxing bodies 11 and 13 has the casing 77 on its back, the casing 77 contains the magnet plate 71 and the first spring 73 that is a magnet pusher to push the magnet plate 71 toward the thermal plate 67. Behind the thermal plate 67, the magnet plate 71 extends along a relaxing surface of the relaxing body 11. In the casing 77, the ceramic heater 69 for generating heat is arranged between the back of the thermal plate 67 and the magnet plate 71, to conduct the generated heat to the back of the thermal plate 67.

The ceramic heater 69 has a rectangular shape, generates heat up to about 180° C., and conducts the generated heat to the thermal plate 67. The ceramic heater 69 is electrically connected to the cord 3.

The magnet plate 71 is made of, for example a neodymium magnet of 15000 Gauss and has a rectangular shape. The magnet plates 71 of the relaxing bodies 11 and 13 are arranged so that S-poles of the magnet plates 71 may face each other. The magnet plates 71 may be arranged so that their N-poles face each other. The magnet plates 71 may be permanent magnets, electromagnets, or a combination of permanent magnet and electromagnet. It is preferred that the magnet plate 71 is of 10000 Gauss or over.

The magnet plate 71 realizes an ion effect and a low-frequency water activating effect. The ion effect magnetically generates negative ions. The low-frequency water activating effect is achieved by low-frequency oscillations of electromagnetic waves and electromagnetic fields around the magnet plate 71 and periodically vibrates water in hair to energize the water. The magnetic plate 71 makes ambient water clusters smaller so that the ambient water may easily permeate into hair.

The first spring 73 is a plate spring that pushes the magnet plate 71 in the casing 77 toward the back of the thermal plate 67, so that the ceramic heater 69 is tightly attached to the back of the thermal plate 67. At the same time, the first spring 73 stably supports the magnet plate 71. The spring constant of the first spring 73 is set so that, when the opposing magnet plates 71 are arranged with their S-poles facing each other, the first spring 73 may not bend due to the repulsive force of the magnet plates 71.

The second spring 75 is supported at a rear end of the casing 77. The second spring 75 serves as a biasing unit to push the relaxing body 11 (13) and elastically adjust a holding state of the relaxing body 11 (13). The second spring 75 is a plate spring having inclined ends 75*a* and 75*b* whose edges engage with projections of the arm part 43*a* in a right-and-left direction of FIG. 7 (a longitudinal direction).

FIGS. 8(*a*) to 10(*c*) show the details of the relaxing body 11 (13), first spring 73, and second spring 75. More precisely, FIG. 8(*a*) is a front view showing the relaxing body, FIG. 8(*b*) is a back view of the same, FIG. 8(*c*) is a plan view of the same, FIG. 8(*d*) is a sectional view of the same, FIG. 8(*e*) a sectional view of a relaxing surface of the relaxing body, FIG. 9(*a*) is a plan view of the first spring, FIG. 9(*b*) is a back view of the same, FIG. 10(*a*) is a plan view of the second spring 75, FIG. 10(*b*) is a front view of the same, and FIG. 10(*c*) is a side view of the same.

In FIGS. 8(*a*) to 8(*d*), the thermal plate 67 of the relaxing body 11 (13) has the flat relaxing surface 87. The relaxing surfaces 87 of the relaxing bodies 11 and 13 face each other.

The relaxing surface 87 of the relaxing bodies 11 and 13 includes a base material 88 of aluminum (Al) and a platinum (Pt) layer 90 formed on the base material 88. Between the base material 88 and the platinum layer 90, a titanium dioxide ($TiO_2$) layer 92 is formed. Between the base material 88 and the titanium dioxide layer 92, a nickel (Ni) layer 94 is formed. Between the titanium dioxide layer 92 and the platinum layer 90, a nickel layer 96 is formed.

The platinum layer 90 has a water-retaining function and a catalytic function. The water-retaining function collects water from air and provide hair with the collected water. The catalytic function atomizes harmful substances and organic compounds.

The titanium dioxide layer 92 has a photocatalytic function that converts the harmful substances atomized by the platinum layer 90 into harmless water and carbon dioxide. In addition, the titanium dioxide layer 92 provides an ion effect to generate negative ions to neutralize harmful substances.

The nickel layer 94 prevents oxidization of the aluminum base material 88 when the platinum layer 90 is plated. The nickel layer 96 helps settle the platinum layer 90 onto the titanium dioxide layer 92.

According to this embodiment, the platinum layer 90 is formed by electrolytic plating to a thickness of 0.01 μm. The platinum layer 90 may be formed by non-electrolytic plating. The titanium dioxide layer 92 is formed by vapor deposition to a thickness of 5 to 15 μm. The titanium dioxide layer 92 is formed when deposited titanium (Ti) changes into titanium dioxide ($TiO_2$) as time passes. Namely, the hair iron 1 as a product includes the titanium dioxide layer 92 altered from a deposited titanium layer. The nickel layers 94 and 96 are each formed by coating to a thickness of 0.5 μm.

The platinum layer 90, titanium dioxide layer 92, and nickel layers 94 and 96 may have optional thicknesses if their respective functions are secured.

The functions of the platinum layer 90 and titanium dioxide layer 92 and the magnetic action of the magnet plate 71 effectively cause oxidization and reduction to permanently process hair while maintaining moisture of the hair.

The casing 77 is hollow and is formed along the flat back 89 of the thermal plate 67. Each end of the casing 77 is open at each end of the relaxing body 11 (13). From one end of the casing 77, it is possible to insert the first spring 73, ceramic heater 69, and magnet plate 71 into the casing 77. The casing 77 has a rear wall 91 having an opening 93. Upper and lower edges of the rear wall 91 have recesses 95 to support and slide the second spring 75.

Figure 9A:
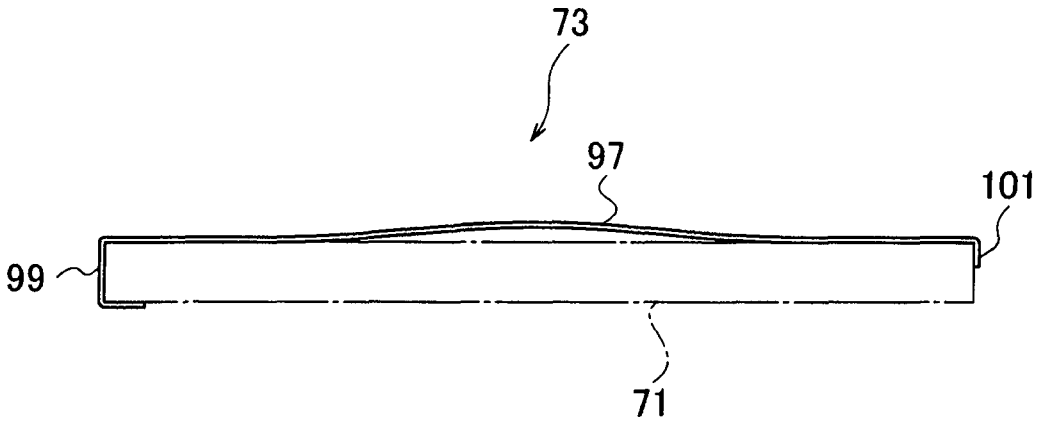
FIG. 9(*a*) is a plan view showing a first spring and FIG. 9(*b*) is a back view showing the same (according to the embodiment of the present invention).
Figure 9B:
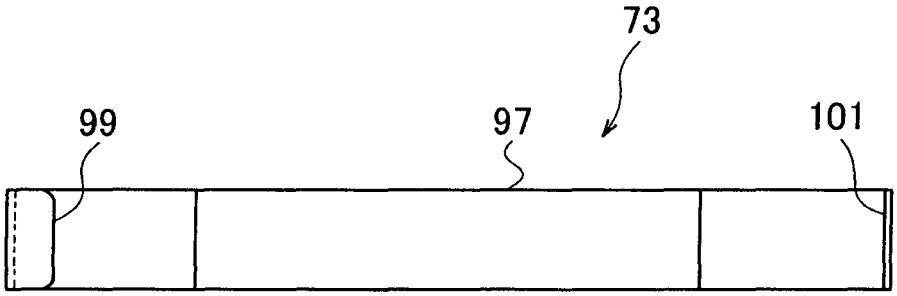

In FIGS. 9(*a*) and 9(*b*), the first spring 73 is a plate spring having a curve 97 at the center thereof. One end of the first spring 73 has a fold 99 and the other end thereof has a bend 101. The fold 99 and bend 101 support the magnet plate 71.

Figure 10A:
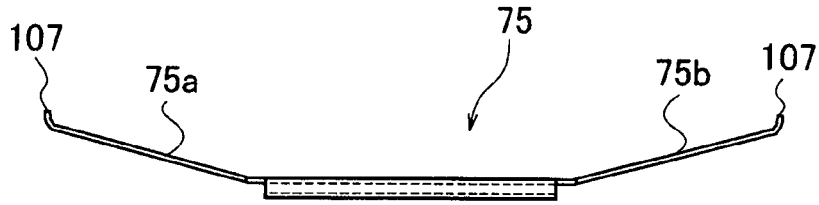
FIG. 10(*a*) is a plan view showing a second spring, FIG. 10(*b*) is a front view showing the same and FIG. 10(*c*) is a side view showing the same (according to the embodiment of the present invention).
Figure 10B:
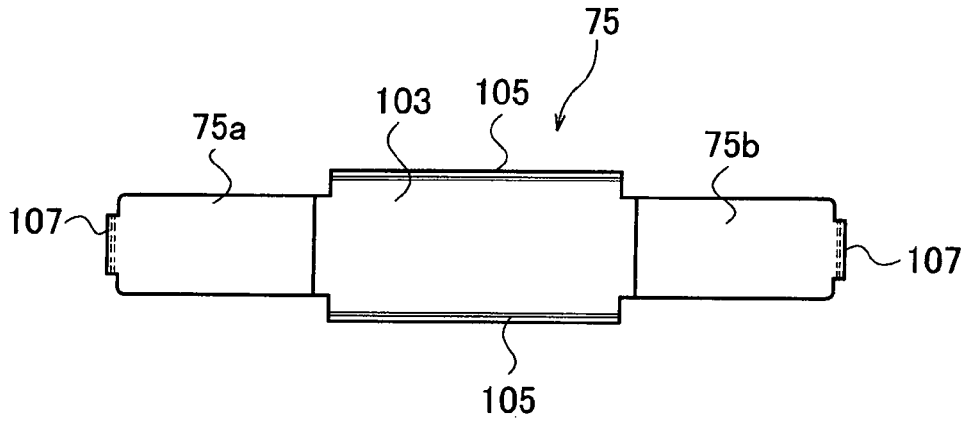
Figure 10C:
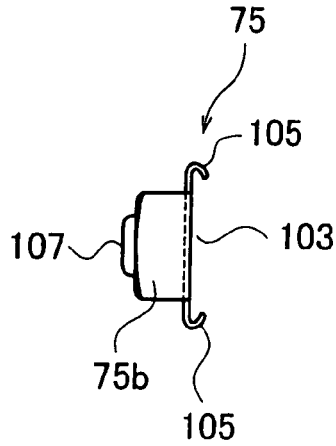
Figure 11A:
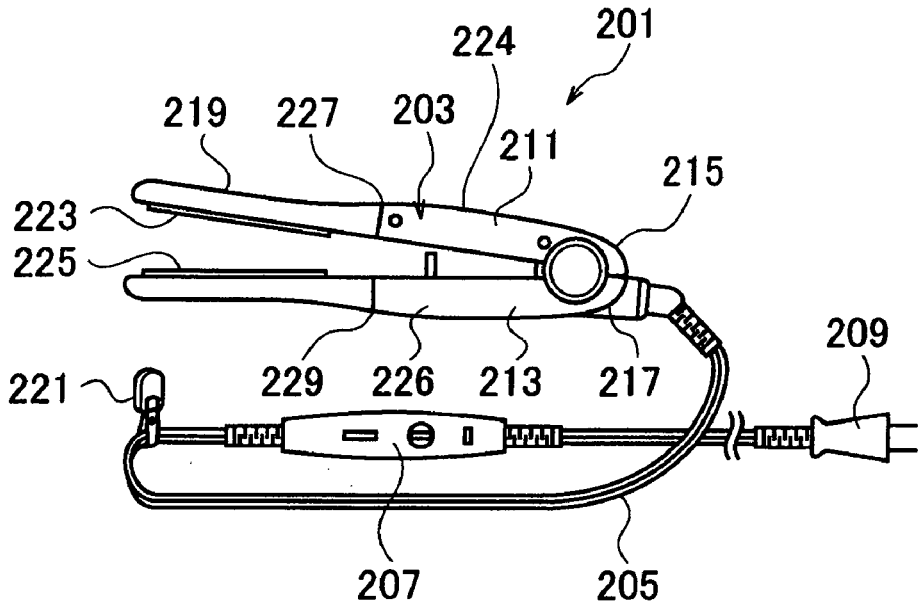
Fig. 11(a) RELATED ART
FIG. 11(*a*) is a general view showing a hair iron and FIG. 11(*b*) is a sectional view showing the inside of the hair iron (according to a related art).
Figure 11B:
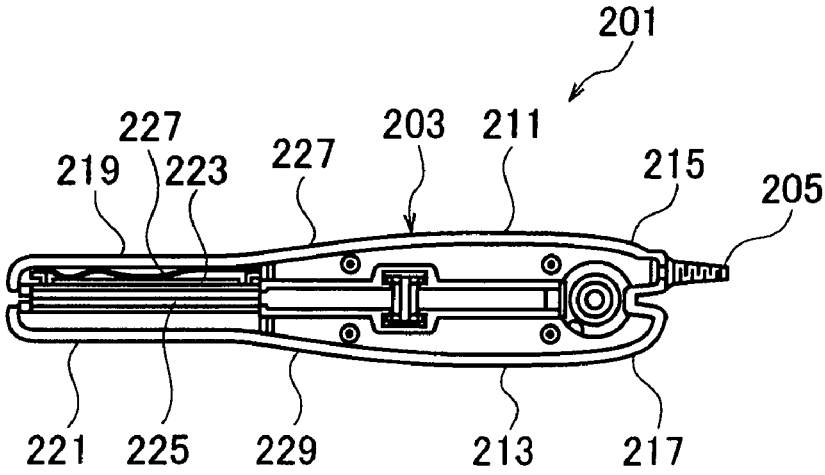
Fig. 11(b) RELATED ART

In FIGS. 10(*a*) to 10(*c*), the second spring 75 is a plate spring includes the ends 75*a* and 75*b* and a flat middle 103. Edges of the middle 103 in an across-the-width direction form hooks 105. Each edge of the ends 75*a* and 75*b* has an engaging part 107 to engage with the projection of the arm part 43*a* as mentioned above.

To assemble these components, the first spring 73 supports the magnet plate 71 with the fold 99 and bend 101 as shown in FIGS. 9(*a*) and 9(*b*). The ceramic heater 69 is arranged on the magnet plate 71. The first spring 73, magnet plate 71, and ceramic heater 69 are assembled into one, which is inserted into the casing 77. At this time, the assembly can easily be inserted into the casing 77 through one of the end openings of the casing 77.

Once the assembly is set in the casing 77, the curve 97 of the first spring 73 bends to produce a repulsive force that tightly pushes the ceramic heater 69 against the back 89 of the thermal plate 67. This results in fixing the assembly of the first spring 73, magnet plate 71, and ceramic heater 69 within the casing 77. As a result, the casing 77 containing the assembly can easily be handled when fabricating the hair iron 1.

The hooks 105 of the second spring 75 are engaged with the recesses 95 of the rear wall 91 of the relaxing body 11 (13), to attach the middle 103 of the second spring 75 to the rear wall 91 of the relaxing body 11 (13). At this time, the second spring 75 is slid from an end of the rear wall 91. Alternatively, the middle 103 of the second spring 75 is placed on the rear wall 91 and is pressed against the rear wall 91 so that the middle 103 may engage with the rear wall 91. When the second spring 75 is attached to the rear wall 91 of the relaxing body 11 (13), the middle 103 of the second spring 75 is attracted by the magnet plate 71 and is thereby positioned with respect to the rear wall 91. In this way, the second spring 75 is adjustable relative to the rear wall 91 of the relaxing body 11 (13) and can correctly and easily be positioned thereon with the magnetic force of the magnet plate 71.

The relaxing body 11 (13) with the second spring 75 is placed in the relaxing body support hole 65 of the arm part 45*a* (45*b*), the other arm part 43*a* (43*b*) is attached to the arm part 45*a*, and the arm parts 45*a* and 43*a* (45*b* and 43*b*) are fixed together with screws at predetermined positions.

Next, operation of the hair iron 1 to straighten curly hair or artificial permanent waves of hair will be explained.

When using the hair iron 1, a first liquid is applied to hair to be treated. The first liquid is a water solution containing a mercapto compound (reducing agent) such as thioglycol and cysteine as base compound and basic materials such as ammonia, monoethanolamine, and triethanolamine added to the solution, to have a pH of 6 to 10. The liquid reduces disulfide bonds of cystine contained in keratin protein of the hair and cuts the same as mercapto groups. Thereafter, the hair is washed with water and is dried with a drier. The hair iron 1 is adjusted to a temperature of 160 to 180° C. and is applied to the hair to straighten the hair.

More precisely, the grips 21 and 23 of the clamp arms 7 and 9 are grasped and the thumb and forefinger or the like are put on the pressing points 25 and 27, to hold hair between the thermal plates 67 of the relaxing bodies 11 and 13. While maintaining this state, the clamp arms 7 and 9 are slid toward the tips of the hair. At this time, the hair is heated and straightened between the thermal plates 67 heated with the ceramic heaters 69.

During the treatment, the platinum layer 90 of the relaxing body 11 (13) collects ambient moisture and makes the hair absorb the moisture, to thereby prevent the hair in treatment from drying. At the same time, the magnet plate 71 achieves a magnetic action to pulverize ambient water clusters so that the hair may easily absorb water and increase water content.

The platinum layer 90 achieves a catalytic function to atomize harmful substances and organic compounds and the titanium dioxide layer 92 carries out a photocatalytic function to convert the substances atomized by the platinum layer 90 into harmless water and carbon dioxide. The photocatalytic function of the titanium dioxide layer 92 also generates negative ions to neutralize harmful substances.

The magnet plate 71 also performs a magnetic action to generate negative ions. In addition, the magnet plate 71 creates low-frequency oscillations of electromagnetic waves and electromagnetic fields around the magnet plate 71 to periodically vibrate water in the hair and activate the water.

In this way, each platinum layer 90 achieves the water sustaining effect on the hair, so that the thermal plates 67 may surely relax the curly hair and secure a gloss of the hair.

The platinum layer 90 and titanium dioxide layer 92 provide a synergistic effect (catalytic effect) to treat hair and promote the health of hair.

The synergistic effect of the platinum layer 90 and titanium dioxide layer 92 decomposes harmful substances into harmless substances to improve a hair treating environment significantly.

The platinum layer 90, titanium dioxide layer 92, and magnet plate 71 provide a synergistic effect of minimizing damages on hair due to heat and pressure produced by the hair iron 1 and atomizing, decomposing, and removing harmful substances and organic compounds, to maintain best hair treating conditions.

When the hair iron 1 is used on hair after carrying out a one-liquid treatment in a permanent process, the molecular decomposing function of the platinum layer 90 atomizes harmful substances and organic compounds. At the same time, the titanium dioxide layer 92 achieves the oxidation-reduction catalytic action and ion effect. These functions and effects deodorize the permanent liquid and decompose harmful substances.

Generally, an odor of ammonia remains on hair after a two-liquid treatment in a permanent process. The platinum layer 90 and titanium dioxide layer 92 can remove the smell of ammonia remaining after the permanent process, to maintain a proper hair treating environment.

Hair is relatively moved at a given speed between the magnet plates 71 whose S- or N-poles are facing each other. The magnet plates 71 generate reduction energy due to the Fleming's right-hand rule. This energy is generated by the S-pole of each magnet plate 71 where electrons turn rightward, to promote a reduction action of the first liquid. The energy also works to close cuticles on the surface of each hair. Closing the cuticles prevents ultraviolet rays from entering and damaging hair.

The reduction energy makes water clusters in the first liquid smaller. The small water clusters help the first liquid permeating into hair. The reduction energy also promotes reduction of the first liquid, to shorten a treatment time to thereby prevent the damage of hair.

Thereafter, a second liquid, i.e., a water solution of oxidant such as sodium bromate and hydrogen peroxide is applied to the hair, to oxidize mercapto groups and produce new disulfide bonds on the hair. This results in settling the straightened state of the hair.

If the magnet plates 71 are arranged such that their S-poles face each other, the magnet plates 71 repel each other when the relaxing bodies 11 and 13 are brought closer to each other by grasping the clamp arms 7 and 9. At this time, the second springs 75 bend in proportion to the repelling action so that the magnet plates 71 become parallel to each other. This results in aligning the relaxing bodies 11 and 13 and automatically making the relaxing surfaces 87 parallel to each other. When the clamp arms 7 and 9 are further grasped to make the relaxing surfaces 87 of the relaxing bodies 11 and 13 touch each other, the relaxing surfaces 87 are already in parallel with each other to touch each other in parallel state.

If the magnet plates 71 are arranged such that their S- and N-poles face each other, the magnet plates 71 quickly attract each other. At this time, the second springs 75 bend to make the magnet plates 71 parallel to each other. Accordingly, when the relaxing surfaces 87 of the relaxing bodies 11 and 13 are brought in contact with each other, the relaxing surfaces 87 are already in parallel with each other to touch each other in parallel state.

In this way, when the relaxing bodies 11 and 13 are brought closer by grasping the clamp arms 7 and 9, the magnet plates 71 and second springs 75 cooperate to automatically make the relaxing bodies 11 and 13 parallel to each other.

When the relaxing bodies 11 and 13 hold hair between them, the relaxing bodies 11 and 13 are already parallel to each other, to surely prevent the hair from being unevenly ironed.

When the magnet plates 71 are arranged with their S- and N-poles facing each other, the relaxing bodies 11 and 13 will quickly attract each other when the clamp arms 7 and 9 are grasped. At this time, the second springs 75 absorb the shock, to properly treat hair.

Each magnet plate 71 is pressed toward the thermal plate 67 with the first spring 73, so that the magnet plate 71 is stably supported on the relaxing body 11 (13). The magnet plates 71 and first springs 73 surely cooperate to align the relaxing bodies 11 and 13 relative to each other.

Between the back 89 of the thermal plate 67 and the magnet plate 71 in the casing 77, the ceramic heater 69 is arranged to conduct heat through the back 89 to the thermal plate 67. The ceramic heater 69 is tightly attached to the back 89 of the thermal plate 67 with the pressing force of the first spring 71, so that the ceramic heater 69 can efficiently conduct heat to the thermal plate 67.

The present invention is not limited to the above-mentioned embodiment.

For example, the body 5 may have an optional shape. The temperature controller and temperature display can be arranged at optional locations.

The magnet plate 71 may be arranged on only one of the relaxing bodies 11 and 13. In this case, the other of the relaxing bodies 11 and 13 is made of a magnetic material to be attracted by the magnet plate 71. It is possible to omit the first spring 73.

Only one of the relaxing surfaces 87 of the relaxing bodies 11 and 13 may have the platinum layer 90, titanium dioxide ($TiO_2$) layer 92, and nickel (Ni) layers 94 and 96.

It is possible to omit the titanium dioxide layer 92 and/or the nickel layers 94 and 96.

What is claimed is:

1. A hair iron, comprising:

clamp arms each having a base, a midsection serving as a grip, and a head, the bases of the clamp arms being pivotally joined together so that the heads may conduct a clamping operation when the grips are grasped;

relaxing bodies attached to the heads of the clamp arms, respectively, the relaxing bodies facing each other, each of the relaxing bodies having a thermal plate and a relaxing surface formed on the thermal plate, the relaxing bodies in the clamping operation holding hair between the relaxing surfaces and relaxing the hair with heat supplied from the thermal plates;

a platinum layer formed on a base material of the relaxing surface of at least one of the relaxing bodies;

a titanium layer formed between the base material and the platinum layer;

a first nickel layer formed between the base material and the titanium layer; and a second nickel layer formed between the titanium layer and the platinum layer.

2. The hair iron of claim 1, further comprising:

a magnet arranged behind the thermal plate of at least one of the relaxing bodies, the magnet being extended along the relaxing surface of the relaxing body.

3. The hair iron claim 1, further comprising:

a biasing unit provided for at least one of the relaxing bodies, the biasing unit being configured to movably support the relaxing body with respect to the corresponding clamp arm such that the relaxing body may move within a predetermined range toward and away from the other relaxing body; and a magnet arranged behind the thermal plate of at least one of the relaxing bodies, the magnet being extended along the relaxing surface of the relaxing body, the magnet generating a force to move the biasing unit and thereby align the relaxing bodies with respect to each other.

4. The hair iron of claim 3, further comprising:

a casing formed on the back of the thermal plate of the relaxing body; and a magnet pusher configured to push the magnet against the thermal plate, the magnet pusher and magnet being housed in the casing.

5. The hair iron of claim 4, further comprising:

a heater arranged between the thermal plate and the magnet in the casing and configured to conduct heat to the thermal plate.

* * * * *